US007118047B1

(12) United States Patent
James

(10) Patent No.: US 7,118,047 B1
(45) Date of Patent: Oct. 10, 2006

(54) TACK SPRAYING APPARATUS

(76) Inventor: Laddie L. James, P.O. Box 877, Opelousas, LA (US) 70571-0877

( * ) Notice: Subject to any disclaimer, the term of this patent is extended or adjusted under 35 U.S.C. 154(b) by 870 days.

(21) Appl. No.: 09/642,868

(22) Filed: Nov. 1, 2000

(51) Int. Cl.
*B05B 9/04* (2006.01)
*B05B 1/20* (2006.01)

(52) U.S. Cl. ..... 239/129; 239/168; 239/172

(58) Field of Classification Search ..... 239/129–146, 239/163, 168–170, 172–76
See application file for complete search history.

(56) References Cited

U.S. PATENT DOCUMENTS 1,097,090 A * 5/1914 Gray ..... 239/126
1,888,072 A * 11/1932 Cederstrom ..... 239/168
2,076,780 A * 4/1937 Haupt ..... 239/135
3,425,407 A * 2/1969 Furman ..... 239/129
4,196,827 A * 4/1980 Leafdale
4,311,274 A * 1/1982 Neal ..... 239/172
4,684,289 A * 8/1987 Gnesa
4,793,731 A * 12/1988 Gnesa
4,828,429 A * 5/1989 Kirchner et al.
4,944,632 A * 7/1990 Dillingham
5,009,547 A * 4/1991 Clark ..... 239/146
5,131,788 A * 7/1992 Hulicsko
5,522,543 A * 6/1996 Herzog ..... 239/129
5,851,085 A * 12/1998 Campbell
5,957,621 A * 9/1999 Clark, Jr. et al. ..... 239/163
5,988,935 A * 11/1999 Dillingham

OTHER PUBLICATIONS

Rosco Manufacturing company, The Rosco Maximizer II asphalt distributor, Mar. 1999, Asphalt Contractor, p. 148.*

* cited by examiner

*Primary Examiner*—David A. Scherbel
(74) *Attorney, Agent, or Firm*—Roy, Kiesel, Keegan and DeNicola

(57) ABSTRACT

A tack spraying device mountable on an engine driven vehicle having a storage tank for maintaining tack stored in the container under pressure during operation, a first line connecting the exhaust pipe of the vehicle engine to the storage tank in a manner to permit transfer of the engine exhaust to the interior of the storage tank and to serve as a source of the pressure within the container, and a second line connecting the storage tank to a spray nozzle in a manner to transfer the tack in the storage tank to the spray nozzle.

21 Claims, 3 Drawing Sheets

TACK SPRAYING APPARATUS

BACKGROUND OF THE INVENTION

1. Field of the Invention

This invention relates in general to tack spraying apparatus, and more particularly to motorized tack spraying vehicles and to spray nozzles utilized in tack spraying apparatus.

2. Prior Art

"Tack" is commonly known in the art to encompass asphaltic emulsions, liquid asphalt, or a variety of other substances that are coated onto a surface to be paved prior to distributing and compacting the hot mix asphalt (HMA) into a mat to bind the HMA to the underlying surface. Typically, the emulsion comprises liquid asphalt, water and an emulsifying agent. In more current formulations, the emulsion can also include polymers, such as SBS and SBR polymers.

Tack is typically applied, just prior to a paving operation, by being sprayed onto the surface to be paved from a spray bar extending transversely over the surface. A tack truck operated independently of the paving machine is normally used for this purpose. The typical tack truck includes a self-propelled chassis on which are mounted a tack storage tank and a tack spray assembly. The truck travels in front of the paving machine while coating the surface to be paved with a layer of tack. The truck travels at 5 to 10 miles per hour, considerably faster than the 20 to 40 feet per minute operational speed of the paving machine, and hence must periodically stop to wait for the paving machine and associated components of the paving system to catch up with the truck. Examples of such tack application systems are disclosed in U.S. Pat. No. 4,828,429 to Kirchner et al; U.S. Pat. No. 4,684,289 to Gnesa, and U.S. Pat. No. 4,793,731 to Gnesa. These systems have various drawbacks such as the paving equipment becoming covered with the tack, the accidental spraying of tack on vehicles passing in an adjacent lane of the road being paved. Solutions to some of these problems have been addressed by incorporating the tack storage tank and tack spraying equipment into the paving machine. Examples of such systems are seen in U.S. Pat. No. 5,851,085 to Campbell, U.S. Pat. No. 5,131,788 to Hulicsko, and U.S. Pat. No. 4,944,632 to Dillingham.

However, serious problems remain in providing a simple tack application system that can uniformly distribute the tack with downtime to fix clogged spray nozzles and transfer lines. This problem has become more acute with the increasing use of polymer material in the tack emulsion. These polymers have a greater tendency to form relatively large globules if the tack becomes cool or after prolonged storage. When this occurs these globules can enter and clog the transfer lines or spray nozzles preventing further dispersion of tack, or cause uneven distribution or application on the road surface.

Another remaining problem is the costs of all the various pieces of equipment involved in applying emulsions on both hot-mix overlay and soil cement applications. Reduction in the number of pieces of equipment and associated costs would be a desirable advance in the art.

Still other problems in the art include the ability to measure the amount of tack within the storage tank, as well as the tack output on a continual basis.

OBJECTS AND SUMMARY OF THE INVENTION

Therefore, one object of this invention is to provide tack spraying equipment that provides a uniform dispersion of polymer containing tack.

Another object of this invention is to provide a tack spraying assembly having an improved spray nozzle.

Still another object of this invention is to provide an improved tack spraying assembly incorporated with a moving vehicle that could include the HMA paving machine.

A still further object is to provide a tack spraying assembly that permits continual determination of the amount of tack material in the storage tank, as well as the flow rate of the tack from the storage tank.

Other objects and advantages of this invention shall become apparent from the ensuing descriptions of the invention.

Accordingly, a tack spraying device mountable on an engine driven moving vehicle is disclosed comprising a storage tank for maintaining tack material stored in the storage tank under pressure during operation, a first line connecting the exhaust pipe of the vehicle engine to the storage tank in a manner to permit transfer of the engine exhaust to the interior of the storage tank and to serve as a source of the pressure within the storage tank, and a second line connecting the storage tank to a spray nozzle in a manner to transfer the tack material in the storage tank to the spray nozzle. In a preferred embodiment a pressure relief valve is operative attached to said storage tank to relieve the pressure in the storage tank at a predetermined pressure level. The preferred predetermined pressure level is set at a pressure sufficient to transfer the tack from the storage tank to the spray nozzle at a rate of at least 0.02 gallons per square yard, more preferably 0.02 to 0.08 gallons per square yard. In an alternate preferred embodiment the spray nozzle has an orifice with a nominal diameter greater than any polymer ball that may develop in the storage tank during spraying of the tack material, preferably a nominal diameter of at least 0.375 inches and has a capacity to permit at least 14, more preferably 14–140, gallons per minute of tack material to flow through the orifice at a pressure of at least about 3 psig with a spray angle of at least 75°.

Alternatively, a motorized tack spraying vehicle is disclosed comprising an engine driven moving vehicle, a tack material storage tank mounted to the vehicle for maintaining tack material stored in the storage tank under pressure during operation, a first line connecting the exhaust pipe of the vehicle engine to the storage tank in a manner to permit transfer of the engine exhaust to the interior of the storage tank and to serve as the source of the pressure within the storage tank, and a second line connecting the storage tank to a spray nozzle in a manner to transfer the tack material in the storage tank to the spray nozzle. In another alternate embodiment, the vehicle can be a HMA or similar type paving machine.

In another alternate embodiment the tack material storage tank is pressurized by other pump devices, such as a hydraulically driven pump that is powered by the vehicle engine or the engine operating the equipment to which the tack material tank is mounted.

BRIEF DESCRIPTION OF THE DRAWINGS

The accompanying drawings illustrate a preferred embodiment of this invention. However, it is to be understood that this embodiment is not intended to be exhaustive, nor limiting of the invention. They are but examples of some of the forms in which the invention may be practiced.

PREFERRED EMBODIMENTS OF THE INVENTION

Without any intent to limit the scope of this invention, reference is made to the figures in describing the preferred embodiments of the invention.

Figure 1:
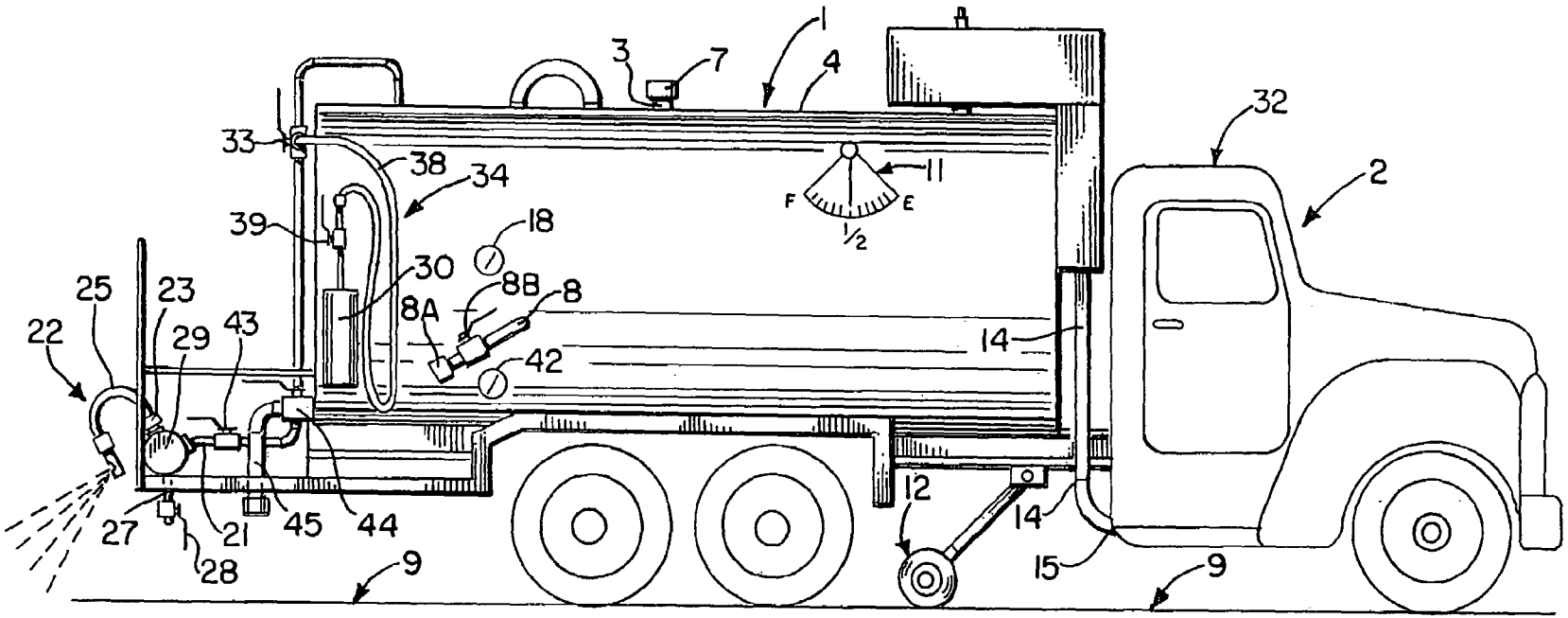
FIG. 1 is a side view of a mobile tack storage tank of this invention illustrating the connection of the truck exhaust to the tack storage tank, the tack discharge line, and the buoy mounted, level indicator for measuring the amount of tack in the storage tank.
Figure 2:
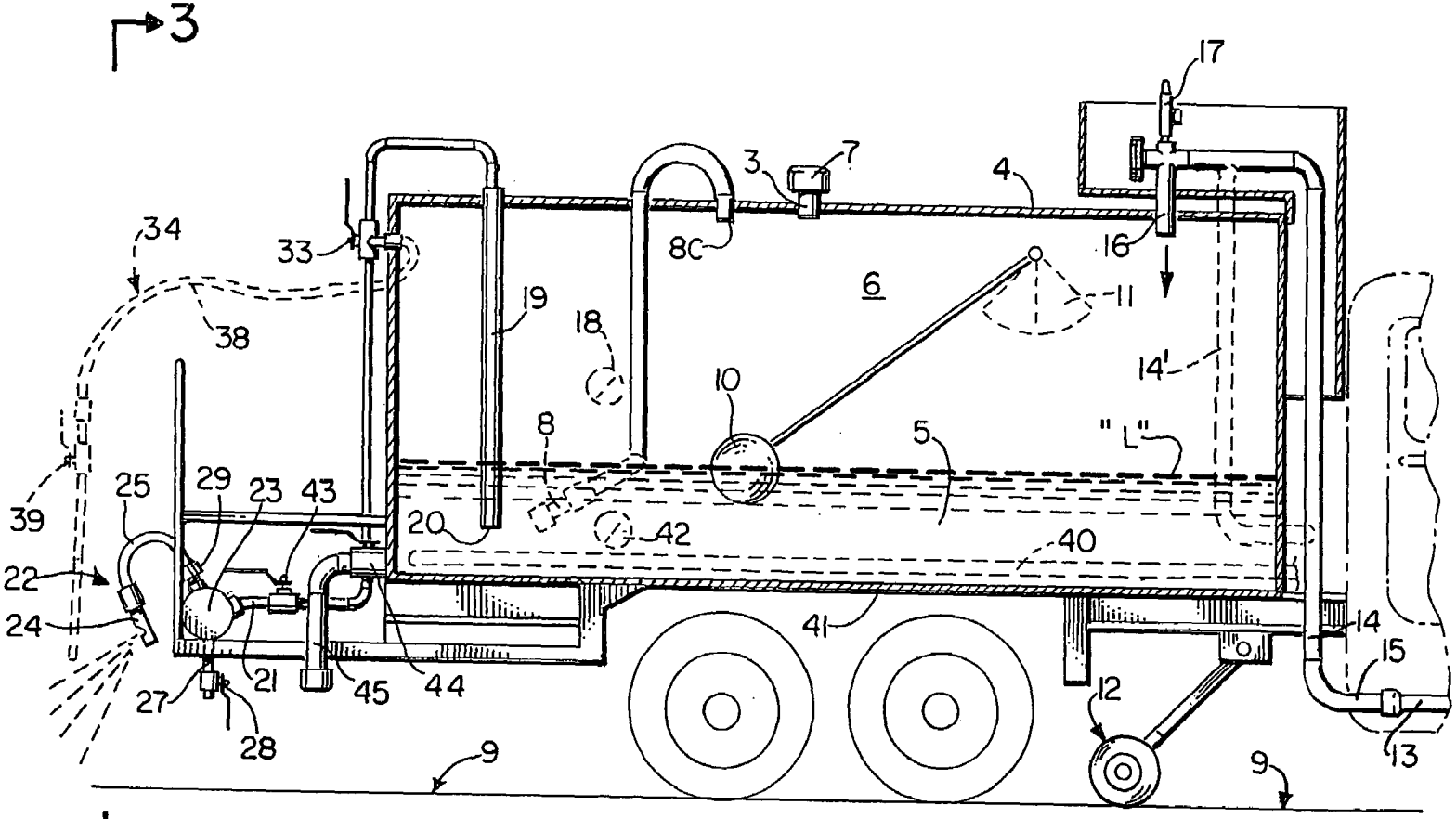
FIG. 2 is a cutaway side view of a mobile tack storage tank of this invention.
Figure 3:
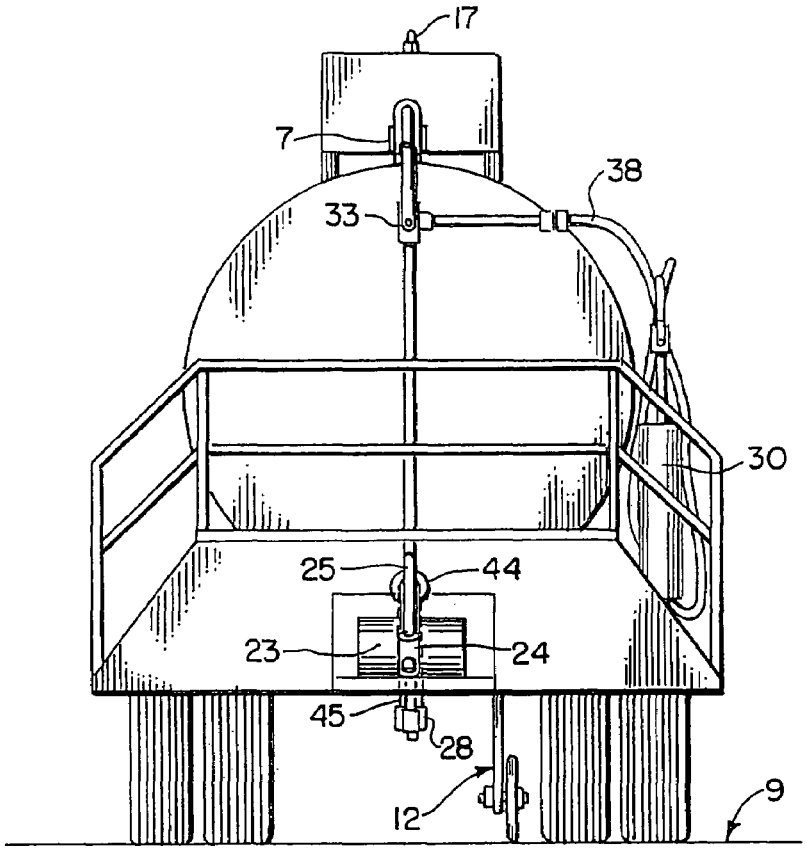
FIG. 3 is a rear view of a mobile tack storage tank of this invention.

Referring to FIGS. 1–3, a tack storage tank 1 is mounted on the chassis of a truck 2 as shown. Tank 1 is provided with fill opening 3 located at the top surface 4 of tank 1. Tack 5 is introduced into tank chamber 6 through fill opening 3. Once the desired amount of tack 5 has been placed in tank 3, fill opening 3 is sealed by cap 7 in any known conventional manner.

In soil cement applications tank 1 is also provided with one or more sealable water inlet pipe 8 to permit water to be introduced into chamber 6. At one end of pipe 8 is a connector 8A, preferably a "quick connection" connector, to which a water pipe may be connected. It is preferred that connector 8A be positioned for easy access by a person standing next to tank 1. In another preferred embodiment, a valve 8B is positioned between pipe connector 8A and the opposite end section 8C of pipe 8 positioned in tank chamber 6. More preferably, end section 8C is positioned above the tack material contained in tank chamber 6 to prevent the emulsion in tank chamber 6 from exiting through pipe 8.

Federal and state construction specifications typically require one to be able to estimate the amount of tack that has been applied to the surface 9 to be paved. To assist in making this estimation it is necessary to measure the change in volume of tack per unit distance traveled by the vehicle. Any conventional tack volume measurement apparatus can be used. One preferred embodiment provides a float 10 operatively attached to a gauge 11 coordinated to match the level "L" of the float in tank chamber 6 to the volume of tack 5 remaining in tank chamber 6. Other known fluid level measuring devices, including ultrasonic or venturi based systems, could also be employed.

Vehicle 2 is also provided with a device that measures the distance traveled by vehicle 2 during the spraying operation. One such device employs a conventional wheel 12 operatively connected to an odometer to measure the distance traveled as the wheel 12 is rotated by its contact with the paving surface 9 during movement of vehicle 2. Other known distance measuring devices, such as a laser or radar based system, could also be used. With the change in volume of the tack 5, the distance traveled during the spraying operation, and the known width of the spray, one can then calculate the amount of tack 5 sprayed per square yard of paving surface 9.

To ensure that an adequate amount of tack 5 is sprayed, prior art devices utilize pumps to transfer the tack 5 from tank chamber 6 to an array of spray nozzles. This requires additional equipment that increases the expense of the tack spraying vehicle. This invention eliminates the need to utilize such pumps by pressurizing tank chamber 6 through the use of the vehicle engine exhaust gases. In addition to eliminating the need for the pumps, this invention also makes use of the polluting exhaust gases to achieve a more environment friendly tack spraying device. To accomplish the pressurization, an exhaust line 14 is attached at one end 15 to the engine exhaust pipe 13 to direct the discharged exhaust gases into exhaust line 14. The opposite end 16 of exhaust line 14 is positioned to discharge the hot exhaust gases into tank chamber 6. In a preferred embodiment at least a portion 14' of exhaust line 14 will positioned within tack 5 where it will act as a heat exchanger to assist in maintaining the tack at the desired temperature. In an alternate preferred embodiment an electric heating coil 40 is positioned within chamber 6, preferably near the inside bottom wall surface 41 forming tank chamber 6 to assist in maintaining tack 5 at the desired temperature for easier flow. The electrical coil is operatively attached to an electrical source (not shown). If desired the temperature of tack 5 can be monitored by temperature gauge 42 having temperature sensors positioned in contact with tack 5.

In another preferred embodiment exhaust line 14 is provided with a conventional pressure relief valve 17 that releases the exhaust gases to the atmosphere should the pressure within tank chamber 6 exceed a predetermined level. If desired, the pressure within tank chamber 6 can be monitored by a conventional pressure gauge 18 operatively attached to tank 1 to sense the pressure level within tank chamber 6.

Tank 1 is also provided with tack transfer line 19 having one end 20 submerged below level "L" and in tack 5. The opposite end 21 of transfer line 19 is operatively attached to spray nozzle system 22 to permit tack 5 to flow from tank chamber 6 through transfer line 19 to spray nozzle system 22. The spray nozzle assembly 22 includes a clean out vessel 23 attached to transfer line end 21 to receive tack 5 from tank chamber 6. It also includes a spray nozzle 24 affixed to one end of pipe 25 whose opposite end 26 is affixed to clean out vessel 23 to receive tack 5 from vessel 23. Spray nozzle system 22 also includes a clean out line 27 that permits the removal of polymer globules trapped in vessel 23 when valve 28 is opened. In a preferred embodiment pipe 25 is attached to clean out vessel 23 by a conventional quick-connect fitting 29 to permit the easy removal of pipe 25 and spray nozzle 24 for cleaning. To facilitate cleaning of spray nozzle 24 and pipe 25, a cleaning tank 30 containing a cleaning solution, such as diesel fuel or other known more environmentally acceptable solvents, is mounted to vehicle chassis 3 near the quick-connect fitting 29 to minimize any environmental problems from any tack spillage or leaking problems from the removed spray nozzle 24 and pipe 25. This position also minimize plugging of spray nozzle 24 that might result from any cooling of tack 5 in spray nozzle 24 resulting from delay in getting spray nozzle 24 into the cleaning solution.

In a preferred embodiment a conventional linear actuator flow control assembly can be operatively attached to transfer line 19 to permit control of the tack flow rate by the vehicle operator positioned in the vehicle cab 32.

In another preferred embodiment switch valve 33 is operatively attached to transfer line 19 at a position exterior to tank chamber 6 to permit the tack to flow to a hand-held spray wand assembly 34, rather than spray nozzle system 22. Spray wand assembly 34 comprises a flexible hose 38 to which is attached at its discharge end a spray wand 39 that can be stored in cleaning tank 30 when not being used. The hand-held spray wand assembly 34 can be used for small area applications or tack spraying in areas not readily accessible to vehicle 2.

Figure 4:
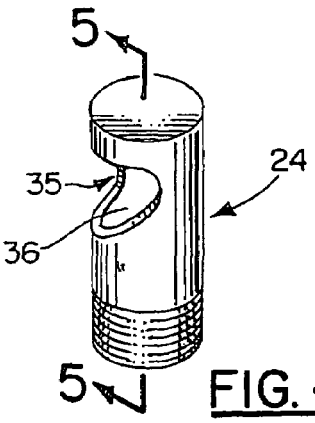
FIG. 4 is a perspective view of a preferred embodiment of the tack spray nozzle utilized in this invention.
Figure 5:
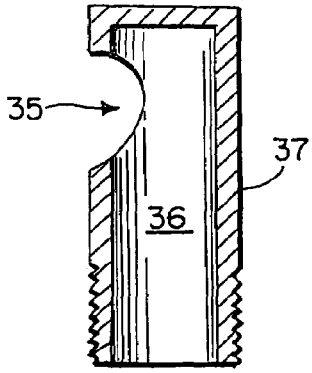
FIG. 5 is a cross-sectional view taken along lines 5—5 of FIG. 4

Turning now to FIGS. 4 and 5, a preferred embodiment of the spray nozzle 24 is illustrated. Spray nozzle 24 is designed to permit a wide angle, preferably at least 75°, flat spray pattern with medium impact. The design is further set to permit uniform spray distribution of medium-sized drops of tack. Spray nozzle 24 is constructed having a round orifice 35 and relatively large unobstructed flow passage 36 formed by nozzle wall member 37. In a preferred embodiment flow passage 36 has a diameter greater than any polymer ball likely to form. A diameter of at least 0.375 inches is the most preferred diameter. It is also preferred that flow passage 36 be sized to permit passage of at least 14 gallons per minute, more preferably 14–140 gallons per minute, at a pressure of about 3 psig, more preferably 10–15 psig. Examples of various acceptable spray nozzles are the FloodJet® spray nozzles manufactured by Spraying Systems Co., North Avenue at Schmale Road, Carol Stream, Ill. 60188.

In operation cap 7 is removed from fill opening 3 and the desired amount of tack 5 is transferred into tank chamber 6. Cap 7 is then replaced on fill opening 3 sealing tank chamber 6. The vehicle engine is started and run to cause the exhaust to pressurize tank chamber 6 to the desired pressure level. Depending on elevation, spraying width, tack composition and other paving factors, the desired pressure will range between 4 and 24 psig. Once the desired pressure has been reached, the vehicle operator opens valve 43 and the flow rate can be set by a conventional linear actuator assembly. The pressure within tank chamber 6 causes tack 5 to enter tack discharge line 19 and flow into and fill vessel 23. Once vessel 23 has been filled the tack is discharged through pipe 25 and sprayed to paving surface 9 through spray nozzle 24 whose orifice 35 has been positioned to direct the tack droplets toward paving surface 9. Upon completion of the spraying operation valve 43 can be closed by activation of a conventional linear actuator. Pipe 25 with spray nozzle 24 are disconnected from quick-connect fitting 29 and placed into the diesel fuel filled tank 30.

When desired any tack 5 remaining in tank chamber 6 after the spraying operation has been completed may be removed by opening valve 44 in tank drain pipe 45. The pressure in tank 1 will force the remaining tack 5 through drain pipe 45 for collection at a more desired environmentally safe area.

In alternate embodiment, tank 1 could be mounted directly on the hot asphalt paving equipment in a manner to permit spray nozzle assembly 23 to discharge tack 5 directly in front of the hot asphalt mix. In this alternate embodiment the exhaust from the hot asphalt mix paving equipment can be used to pressurize tank 1.

There are of course other alternate embodiments which are obvious from the foregoing descriptions of the invention which are intended to be included within the scope of the invention as defined by the following claims.

What I claim is:

1. A tack spraying device mountable on a vehicle comprising:

a. an engine having an exhaust pipe for emitting exhaust gases during the operation of the engine, the engine being mountable to the vehicle, b. a storage tank for maintaining tack material stored in the storage tank under pressure during operation, c. a first line connecting the exhaust pipe of the engine to the storage tank in a manner to permit transfer of the engine exhaust to the interior of the storage tank and to serve as a source of the pressure within the storage tank, and d. a second line connecting the storage tank to a spray nozzle in a manner to transfer the tack material in the storage tank to the spray nozzle.

2. A tack spraying device according to claim 1 wherein a pressure relief valve is operative attached to said storage tank to relieve the pressure in the storage tank at a predetermined pressure level.

3. A tack spraying device according to claim 2 wherein the predetermined pressure level is about 4 psig or greater.

4. A tack spraying device according to claim 2 wherein the predetermined pressure level is about 14 psig.

5. A tack spraying device according to claim 2 wherein the predetermined pressure level is set a pressure sufficient to transfer the tack material from the storage tank to the spray nozzle at a rate of at least 0.02 gallons per square yard.

6. A tack spraying device according to claim 5 wherein said rate is between 0.02 and 0.08 gallons per square yard.

7. A tack spraying device according to claim 1 wherein the spray nozzle has an orifice with a nominal diameter of at least 0.375 inches and has a capacity to permit at least 14 gallons per minute of tack material to flow through the orifice at a pressure of at least about 3 psig with a spray angle of at least 75°.

8. A tack spraying device according to claim 1 wherein the spray nozzle has an orifice with a nominal orifice diameter greater than any polymer ball that may develop in the storage tank during spraying of the tack material.

9. A tack spraying device having a tack material storage tank and a line operatively attached to the storage tank and a spray nozzle to permit tack material in the storage tank to flow to and through the spray nozzle, the improvement to which comprises the spray nozzle has an orifice with a nominal orifice diameter greater than any polymer ball that may develop in the storage tank during spraying of the tack material.

10. A tack spraying device according to claim 9 wherein the spray nozzle has an orifice with a nominal diameter of at least 0.375 inches and has a capacity to permit at least 14 gallons per minute of tack material to flow through the orifice at a pressure of at least about 3 psig with a spray angle of at least 75°.

11. A tack spraying device according to claim 10 wherein said capacity is set to permit about 14 to about 140 gallons per minute of tack material to flow through the orifice.

12. A tack spraying device according to claim 1 wherein the engine drives the vehicle.

13. A motorized tack spraying vehicle comprising an engine-driven moving vehicle, --said engine having an exhaust pipe, --a tack material storage tank mounted to the vehicle for maintaining tack material stored in the storage tank under pressure during operation, first line connecting the exhaust pipe of the vehicle engine to the storage tank in a manner to permit transfer of the engine exhaust to the interior of the storage tank and to serve as --a-- source of the pressure with the storage tank, and a second line connecting the storage tank to a spray nozzle in a manner to transfer the tack material in the storage tank to the spray nozzle.

14. A motorized tack spraying vehicle according to claim 13 wherein a pressure relief valve is operative attached to said storage tank to relieve the pressure in the storage tank at a pre-determined pressure level.

15. A motorized tack spraying vehicle according to claim 14 wherein the pre-determined pressure level is about 4 psig or greater.

16. A motorized tack spraying vehicle according to claim 15 wherein the pre-determined pressure level is about 14 psig.

17. A motorized tack spraying vehicle according to claim 15 wherein the predetermined pressure level is set a pressure sufficient to transfer the tack material from the storage tank to the spray nozzle at a rate of at least 0.02 gallons per square yard.

18. A motorized tack spraying vehicle according to claim 17 wherein said rate is between 0.02 and 0.08 gallons per square yard.

19. A motorized tack spraying vehicle according to claim 13 wherein the spray nozzle has an orifice with a nominal diameter of at least 0.375 inches and has a capacity to permit at least 14 gallons per minute of tack material to flow through the orifice at a pressure of at least about 3 psig with a spray angle of at least 75°.

20. A motorized tack spraying vehicle according to claim 19 wherein said capacity is set to permit from about 14 to about 140 gallons per minute of tack material to flow through the orifice.

21. A motorized tack spraying vehicle according to claim 14 wherein the spray nozzle has an orifice with a nominal orifice diameter greater than any polymer ball that may develop in the storage tank during spraying of the tack material.

* * * * *